US007100499B2

(12) United States Patent
Yu Chen

(10) Patent No.: US 7,100,499 B2
(45) Date of Patent: Sep. 5, 2006

(54) STRAP PRESSING DEVICE FOR A STRAP PACKING APPARATUS

(76) Inventor: Hsiu-Man Yu Chen, No. 27, Sec. 1, Ta Fu Road, Tan Tzu Hsiang Taichung (TW) 427

( * ) Notice: Subject to any disclaimer, the term of this patent is extended or adjusted under 35 U.S.C. 154(b) by 15 days.

(21) Appl. No.: 10/995,436

(22) Filed: Nov. 24, 2004

(65) Prior Publication Data

US 2006/0107624 A1 May 25, 2006

(51) Int. Cl.
*B65B 13/24* (2006.01)

(52) U.S. Cl. ..... 100/30; 100/33 PB; 100/282; 53/592; 140/93.4

(58) Field of Classification Search ..... 100/29, 100/30, 33 R, 33 PB, 280, 282, 8; 53/582, 53/592; 140/93.2, 93.4
See application file for complete search history.

(56) References Cited

U.S. PATENT DOCUMENTS 6,047,742 A * 4/2000 Barlasov ..... 140/123.6
6,332,306 B1 * 12/2001 Finzo et al. ..... 53/592
6,463,847 B1 * 10/2002 Rauch ..... 100/29
6,564,701 B1 * 5/2003 Liu et al. ..... 100/29
6,698,460 B1 * 3/2004 Marsche ..... 140/93.2

* cited by examiner

*Primary Examiner*—Derris H. Banks
*Assistant Examiner*—Jimmy Nguyen
(74) *Attorney, Agent, or Firm*—Troxell Law Office, PLLC

(57) ABSTRACT

A strap pressing device for a strap packing apparatus includes a strap presser, an eccentric shaft, and a spring. The eccentric shaft consists of a first shaft and a second shaft eccentrically connected to the first shaft and received in an oval hole of the strap presser. The first shaft is pivotally connected to a side of the base. A spring is fitted around the second shaft in the oval hole, so the strap presser may be pressed down to press a strap closely contact the upper surface of the base, and also moved bias by movement of the second shaft when the first shaft is moved by a lever so that the strap presser may be moved bias to rise up quickly to leave the upper surface of the base so as to prevent a curved bottom surface of the strap presser from frictionally sliding on the strap to give scar on it.

6 Claims, 6 Drawing Sheets

STRAP PRESSING DEVICE FOR A STRAP PACKING APPARATUS

BACKGROUND OF THE INVENTION

1. Field of the Invention

This invention relates to a strap pressing device for a strap packing apparatus, particularly to one capable to prevent a strap from being scarred or hurt.

2. Description of the Prior Art

A conventional strap packing apparatus 10 shown in FIG. 1 includes a base 11, a cutting device 12 provided beside the base 11, a strap roll supporter 13 and a strap pressing device 14. A lever 15 and a grip 16 are pivotally connected to the base 11 for performing strapping, strap pressing, tightening and cutting. The pressing device 14 is provided with a body 141, a pressing block 142 is pivotally connected to the body 141, and a toque spring 143 located between the body and the pressing block 143 for elastically pressing the pressing block 142 to press tightly overlapped ends of a strap on the base 11. When the lever 15 is pressed down, the cutting device 12 cuts the strap, and at the same time the body 141 of the strap pressing device 14 rotates forward bias, forcing the pressing block 142 also moving forward bias to release the strap pressed so far, finishing retreating of the strap.

However, when the conventional strap pressing device 14 retreats the strap, the pressing block 142 moves together with the body 14 bias to release the strap, but at the beginning of moving bias the pressing block 142 is still moved bias by the torque spring 143, with the sharp front edge and a partial rough bottom surface of the pressing block 142 producing sliding frictionally against the surface of the strap, which is then easily scarred to get cut lines on its surface, resulting in the strap's appearance and worsened in strength resisting tension. And if worse, the strap may be broken off. Moreover, the frictional slide may increase pressing resistance against the lever 15, and strap retreating operation needs more force.

SUMMARY OF THE INVENTION

The strap pressing device for a strap packing apparatus includes a strap presser, an eccentric shaft and a torque spring. The eccentric shaft consists of a first shaft and a second shaft eccentrically connected to the first shaft. The strap presser has a lateral oval hole for the second shaft to extend therein, and the first-shaft is pivotally connected to a side of the base, with the torque spring fitting around the second shaft and located in the oval hole. When the strap presser is properly moved bias by the second shaft of the eccentric shaft, a curved bottom surface of the strap presser quickly rises up, preventing the curved bottom surface from frictionally sliding on the strap, so the strap may not be scarred to keep neat look and better strap packing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
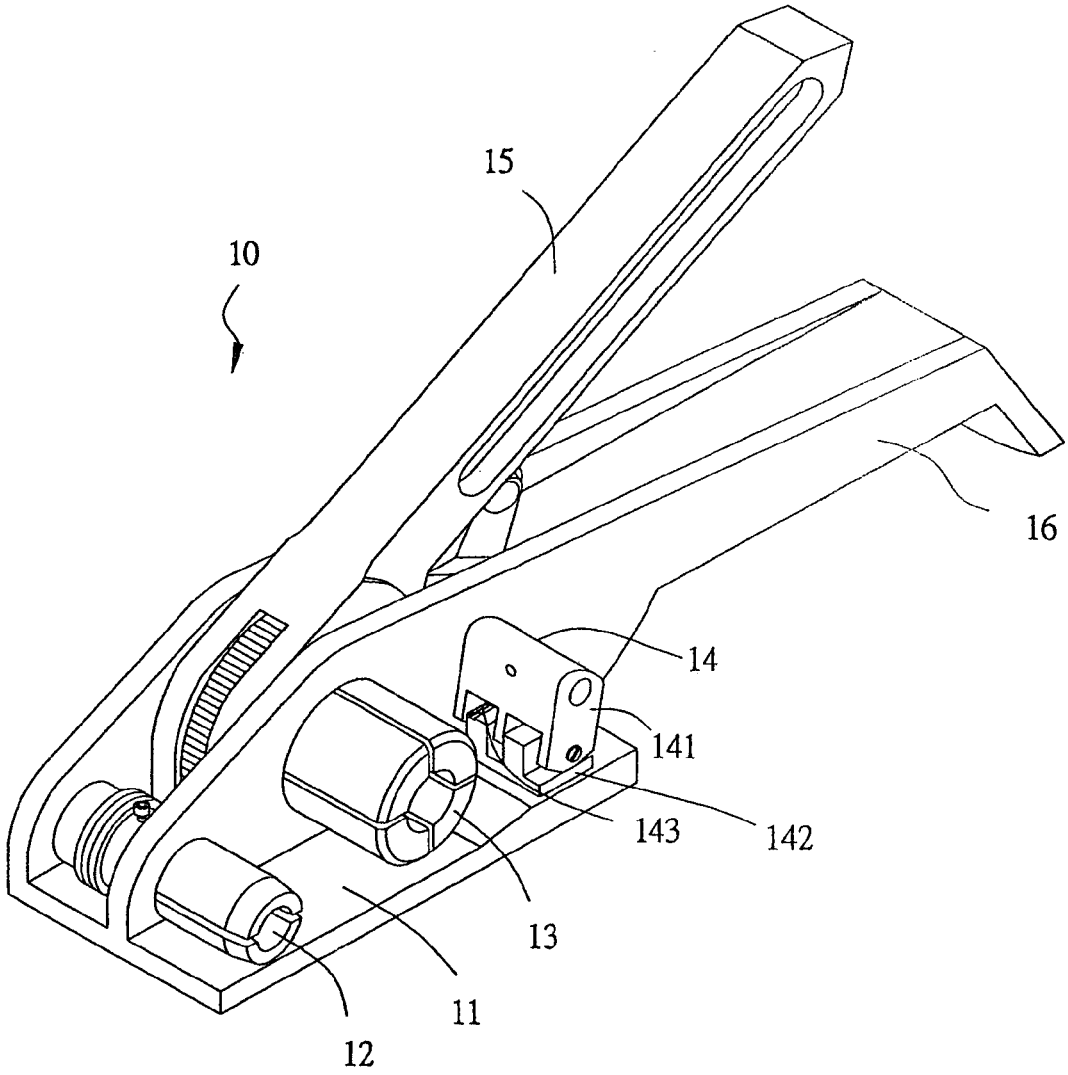
FIG. 1 Prior Art
FIG. 1 is a perspective view of a conventional strap packing apparatus.
Figure 2:
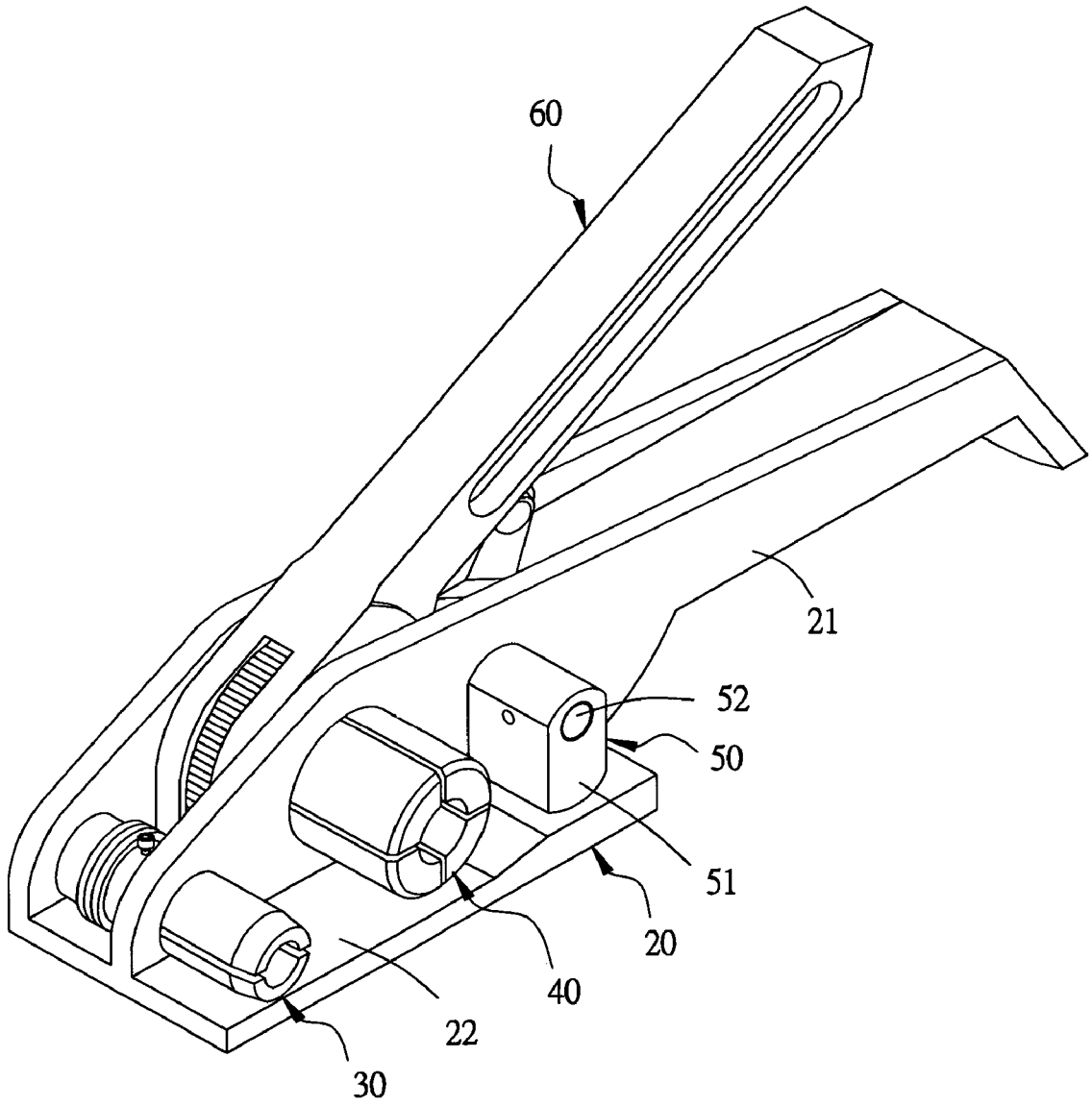
FIG. 2 is a perspective view of a strap packing apparatus with a strap pressing device in the present invention.

A preferred embodiment of a strap pressing device 50 for a strap packing apparatus in the present invention, as shown in FIG. 2, is installed on a base 20 of a strap packing apparatus, which also has a grip 21 formed integral and extending rearward on the base 20, a cutting device 30 provided on a front portion of the base 20, a strap roll supporter 13 between the cutting device 30, and a lever 60 pivotally connected on the base 20.

Figure 3:
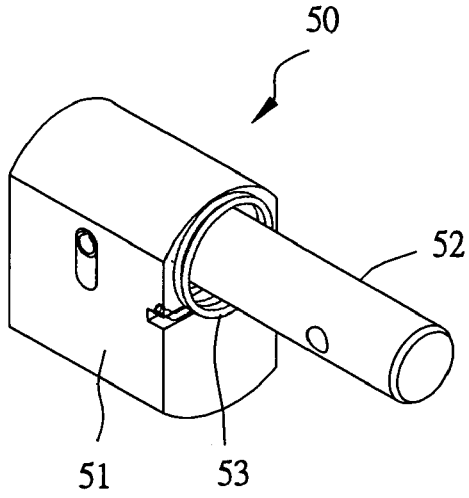
FIG. 3 is a perspective view of the strap pressing device in the present invention.
Figure 4:
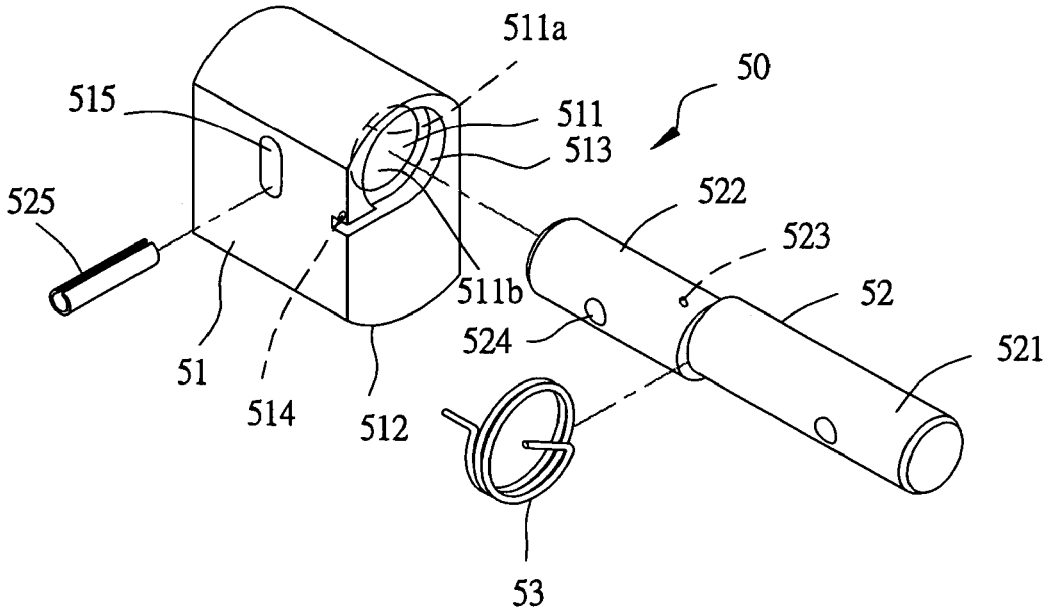
FIG. 4 is an exploded perspective view of the strap pressing device in the present invention.

The strap pressing device 50, as shown in FIGS. 3 and 4, consists of a strap presser 51, an eccentric shaft 52 and a torque spring 53.

The strap presser 51 is shaped as a block, having a oval hole 511 formed laterally in an upper portion, a curved bottom surface 512 formed in the bottom, a spring recess 513 formed in an outer end of the oval hole 511 and being larger than the oval hole 511, an insert hole 514 bored in an outer surface of the spring recess 513, and a limit slot 515 formed vertically in an upper intermediate portion of a side wall. Further, the oval hole 511 has a first recess 511*a* in an upper section and a second recess 511*b* in a lower section, and a longer diameter being almost parallel to the vertical length of the strap presser 51.

Figure 5:
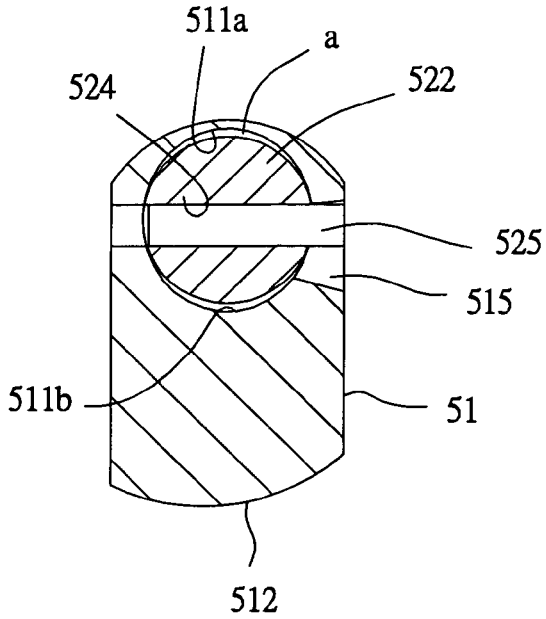
FIG. 5 is a side cross-sectional view of the strap pressing device in the present invention.
Figure 6:
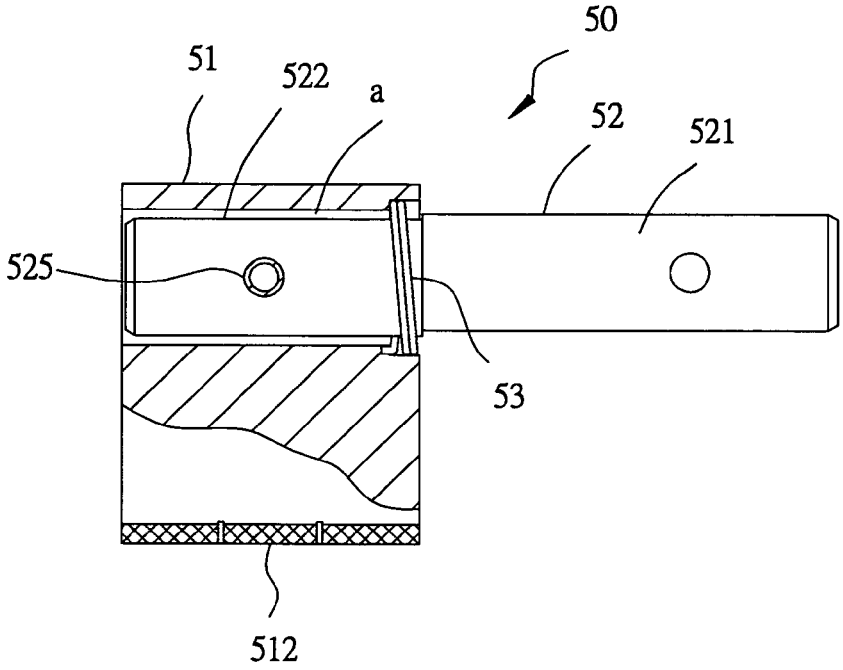
FIG. 6 is another side cross-sectional view of the strap pressing device in the present invention.

The eccentric shaft 52 consists of a first shaft 521 and a second shaft 522 mutually connected in an eccentric condition, and the first shaft 521 is pivotally connected to one side of the base and the second shaft 522 is received in the oval hole 511. The second shaft 522 has a diameter nearly equal to a shortest diameter of the oval hole 511, contacting the inner wall of the shortest diameter to interact, forming a proper gap (a) between its outer surface and the longest-diameter wall of the oval hole 511, in other words, the first recess 511*a* and the second recess 511*b* of the oval hole 511, as shown in FIG. 5 and 6. So the second shaft 522 can move in a proper bias to the strap presser 51. Further, an insert hole 523 is bored in the outer wall of the second shaft 522 near the first shaft 521, and the second shaft 522 has a lateral pin hole in the intermediate portion for a pin 525 to insert therein and further in the limit slot 515 of the strap presser 51 so that the strap presser 51 can move bias in limited distance to the eccentric shaft 52.

The torque spring 53 used in the invention fits around the second shaft 522, and located in the spring recess 513, having its one end inserted in the insert hole 514 of the strap presser 51 and its other end inserted in the insert hole 523 of the second shaft 522. Then the curved bottom surface 512 of the strap presser 51 receives the force of the torque spring 53 and presses elastically against a corresponding wall of the base 20 in a biased condition.

Figure 7:
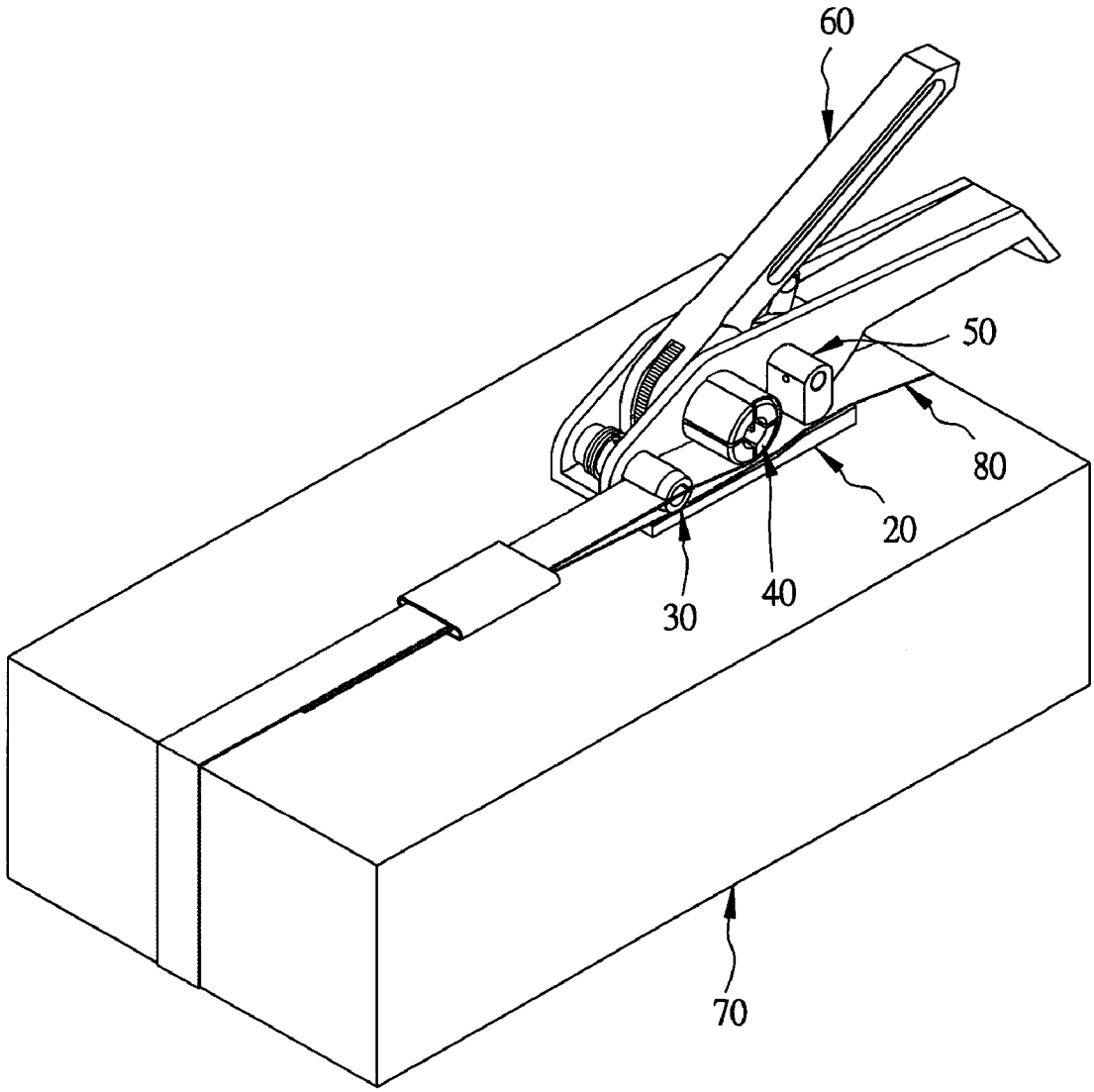
FIG. 7 is a perspective view of the strap packing apparatus performing strap packing in the present invention.
Figure 8A:
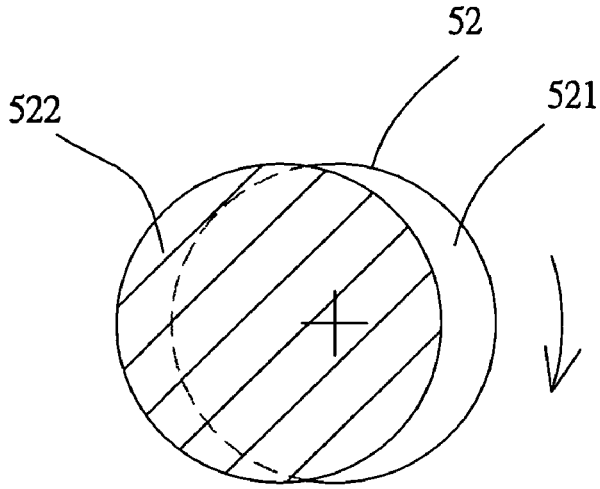
FIG. 8*a* is a side view of the mutual relation of a first shaft and a second shaft of an eccentric shaft in an unbiased condition in the present invention.
Figure 8B:
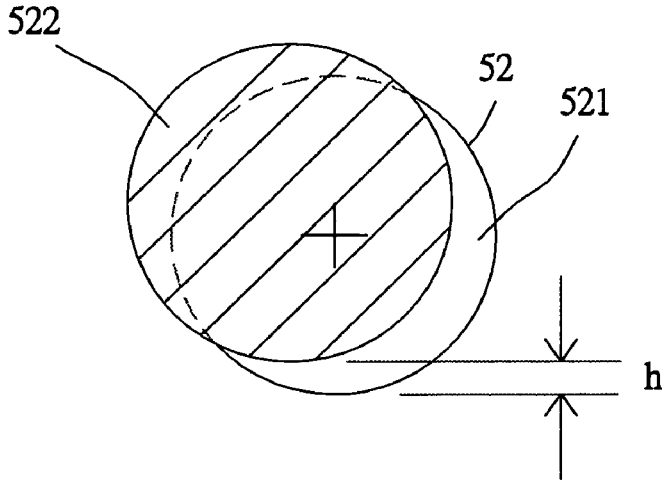
FIG. 8*b* is a side view of the mutual relation of the first shaft and the second shaft of the eccentric shaft in a biased condition in the present invention.

In using the strap pressing device 50, as shown in FIG. 7, after the strap 80 are surrounded around an object 70 to be strap packed and tightened, the two ends of the strap 80 are overlapped and pressed, by pressing down the lever 60 for activating the cutting device 30 at the same time to cut one end of the strap 80, and the strap pressing device 50 also releases the strap 80 to let it retreat. Meanwhile, when the lever 60 is pressed to activate the first shaft 521 of the strap pressing device 50, the first shaft 521 rotates clockwise, as shown in FIGS. 8*a* and 8*b*, to rotate the second shaft 522 synchronously, which then rises up a little distance (h) so that the strap presser 51 also rotates clockwise bias, rising up quickly. At this time the curved bottom surface 512 quickly moves forward, leaving the relative strap surface without frictionally sliding on the strap 80, which is then not to be scarred or damaged

THE INVENTION HAS THE FOLLOWING ADVANTAGES

1. The strap presser 51 moves forward together with the second shaft 522 and rises up quickly at the same time so that the curved bottom surface 512 may leaves, not frictionally sliding on the strap 80, which is accordingly not to be scarred or hurt.

2. As the strap presser 51 moves forward bias and rises up quickly, not frictionally sliding on the strap 80, so the resistance against the lever 60 can be reduced to facilitate retreating of the strap 80 with less force.

3. The design of the second shaft 522 moving in a limited scope in the oval hole 511 of the strap presser 51 can produce a lateral gap (a) between the outer surface of the second shaft 522 and the inner wall of the largest diameter of the oval hole 511 so that the strap presser 51 has a proper moving bias to enable the curved bottom surface closely contact the relative upper surface of the base 20 for tightly pressing the strap 80.

While the preferred embodiment of the invention has been described above, it will be recognized and understood that various modifications may be made therein and the appended claims are intended to cover all such modifications that may fall within the spirit and scope of the invention.

What is claimed is:

1. A strap pressing device for a strap packing apparatus combined with one side of a base of a strap packing apparatus, said strap pressing device comprising:

a strap presser having an oval hole in an upper portion, and a curved surface formed in a bottom;

an eccentric shaft consisting of a first shaft and a second shaft eccentrically connected to said first shaft, said first shaft pivotally connected to one side of said base, said second shaft positioned in said oval hole and having its outer diameter nearly equal to a smaller diameter of said oval hole, said second shaft moving said strap presser sway eccentrically and rise up quickly, a preset lateral gap formed between said second shaft and the wall of the larger diameter of said oval hole so that said strap presser may be moved up and down eccentrically by said second shaft to enable said curved bottom surface closely contacting an upper surface of said base; and a spring provided to fit around said second shaft in said oval hole to elastically push said strap presser to move bias up and down so as to press said curved bottom surface against an upper surface of said base.

2. The strap pressing device for a strap packing apparatus as claimed in claim 1, wherein said oval hole of said strap presser has its larger diameter is parallel to the upright direction of said strap presser, having a first recess in an upper end and a second recess in a lower end so that a lateral gap is formed between said second shaft and said oval hole.

3. The strap pressing device for a strap packing apparatus as claimed in claim 1, wherein said first shaft is connected integral with said second shaft.

4. The strap pressing device for a strap packing apparatus as claimed in claim 1, said second shaft has a diametrical pin hole in an intermediate portion, said strap presser has a slot vertically in its side wall to align to said pin hole of said second shaft for a pin to fit therein for limiting said strap presser move bias up and down in a certain distance.

5. The strap pressing device for a strap packing apparatus as claimed in claim 1, wherein said spring is a torque spring.

6. The strap pressing device for a strap packing apparatus as claimed in claim 1, wherein said oval hole further has a spring recess formed in an outer end, and said spring recess has a larger diameter than that of said oval hole for a torque spring to fit therein after fitted around said second shaft, said strap presser and said second shaft are both provided with an insert hole for the two ends of said spring to insert in respectively to secure said spring in place.

* * * * *